United States Patent [19]

Dietrich

[11] 4,398,827

[45] Aug. 16, 1983

[54] SWIRL MIXING DEVICE

[76] Inventor: David E. Dietrich, 8450-101 Via Sonoma, La Jolla, Calif. 92037

[21] Appl. No.: 205,147

[22] Filed: Nov. 10, 1980

[51] Int. Cl.[3] ..... B01F 13/02

[52] U.S. Cl. ..... 366/107; 239/404; 239/406; 261/79 A; 261/117; 366/101; 366/165; 366/178; 366/341

[58] Field of Search ..... 366/11, 76, 96, 101, 366/106, 107, 165, 167, 173, 176–178, 341, 349; 261/79 A, 79 R, 117, 124; 239/404–406

[56] References Cited

U.S. PATENT DOCUMENTS

| | | | |
|---|---|---|---|
| 981,098 | 1/1911 | McCaskell | 366/107 X |
| 1,451,063 | 4/1923 | Anthony | 239/406 |
| 3,047,275 | 7/1962 | Cox | 366/165 X |
| 3,705,710 | 12/1972 | Mueller | 366/11 |

*Primary Examiner*—Philip R. Coe
*Assistant Examiner*—Timothy F. Simone
*Attorney, Agent, or Firm*—John L. Haller

[57] ABSTRACT

A swirl mixing device particularly suited for the thorough and complete mixing of a plurality of fluid reagents is disclosed. The swirl mixing device is generally composed of a cylindrically shaped container having a closed bottom and an open upper exhaust. A plurality of swirl injection levels are provided along the length of the container. Each of said swirl injection levels includes an injector set having a plurality of symmetrically spaced injectors distributed around the inner surface of the chamber wall in a plane perpendicular to the chambers's longitudinal axis. Each of said injectors in a given injector set has an injector axis directed at a given tangent circle with common radial and azimuthal directional components whereby the injected reagent enters the chamber with swirl. The injector set of each of the separate swirl injection levels has either positive or negative azimuthal components thereby injecting the respective reagents into the chamber with either positive or negative swirl such that the cumulative swirl of all reagents is small. The injector set for each of the swirl injection levels communicates with an annular chamber of a corresponding feed manifold whereby the reagent is received by and distributed around the annular chamber for injection into the mixing chamber through the injectors.

19 Claims, 10 Drawing Figures

SWIRL MIXING DEVICE

BACKGROUND OF THE INVENTION

The present invention relates to a mixing apparatus and more particularly to an apparatus suited to mix fluids such as liquids, gases or fluidized suspensions.

A common device for mixing fluids includes beater structures such as the conventional household mixer which uses a mechanical device to physically agitate the fluid combination.

Similar in concept to the mechanical beater, a second version of the physical mixing device uses physical agitation imposed by the injection of a non-interacting substance into a container holding the combination of reagents. The non-interacting substance is injected in a manner to create physical turbulence within the container thereby mixing the reagents. Examples of such prior art devices are shown in U.S. Pat. Nos. 3,047,275 and 4,019,720.

A second type of mixing device causes mixing by intersecting the flows of the various reagents. The reagents mix as a result of the turbulence achieved by the interaction of the respective flows. Examples of these devices are shown in U.S. Pat. Nos. 981,098 and 3,826,907.

The present invention is directed to an improvement of the intersecting flow type device or specifically to the type of device which uses opposed flows.

The prior art devices which use opposed reagent flows employ reagent injection structures which direct the reagents into a mixing chamber in a tangential direction, nearly ninety degrees (90°) to a radial line to the injector opening. In these devices the reagent flows intersect the chamber wall to divert circumferentially the reagent around the chamber.

This tangential injection results in the reagent located towards the outer rim of the chamber to be moving rapidly, and the reagent located towards the center of the chamber to be moving more slowly, resulting in a central "dead region" and significant viscous energy dissipate (frictional losses) near the walls.

The existence of the dead region and frictional losses retards the ability of the reagent to thoroughly mix and reduces the amount of swirl energy available for mixing and/or atomization, thereby reducing the overall volume efficiency of the mixing device.

Mixing chambers are frequently used as chemical reaction chambers because of the high degree of physical contact between the reagents. The common form of chemical reaction is the oxidation of a fluid such as in a combustion chamber. In such a chamber the existence of a dead region and incomplete mixing results in "hot spots" which cause the formation of noxious pollutants. Further, chemical reactions against or at the outer chamber walls are also undesirable due to boundary effects.

SUMMARY OF THE INVENTION

The present invention provides a swirl mixing device generally of the intersecting or opposed flow type which significantly reduces or eliminates dead regions within the mixing chamber and also the undesirable effect of the chamber walls on the mixing process.

The swirl mixing device of the present invention is basically composed of a mixing chamber having a bottom, an exhaust, and a plurality of swirl injection levels. Each of the injection levels includes an injector set having a plurality of individual injectors symmetrically distributed around the interior surface of the chamber walls. Each of said injectors in a given injector set is located in a common plane which plane is perpendicular to the longitudinal axis of the chamber. The axis of each injector within a given injector set has common azimuthal and radial directional components, thereby directing the respective reagent flow at a predetermined tangent circle.

The tangent circle is that circle whose radius (smaller than the radius of the chamber) is such that all injector axes of a given injector set will tangentially intersect such circle.

Each respective reagent communicates with its own injector set through a corresponding annular chamber of a respective feed manifold. The feed manifold includes conventional connecting means to a reagent source having conventional plumbing and valve means, whereby the pressure of the reagent communicating with the feed manifold can be controlled.

The injector axes of each injector of a given injector set is formed with either a positive or a negative azimuthal component (taken from a chamber radial through the injector opening) resulting in the injection of reagent into the chamber with either negative or positive swirl. Swirl is generally considered to mean the circulating flow of the reagent within the chamber. The selection of either a positive or negative azimuthal component of the injector axes of the injectors within the given injector sets is predetermined such that the swirls of the plurality of reagents counterbalance each other.

Mixing of the reagents is provided at the intersection of the opposed reactant swirls due to the high physical turbulence, caused by shearing forces and fluid instabilities experienced in this region.

A given reagent is injected into the chamber with a given swirl and corresponding angular momentum. The remaining reagents are injected into the chamber in a similar manner, generally with opposed or counterbalancing swirl, so that the resulting angular momentum summed over all injected reagents is small compared to the angular momentum of an individual injected reagent (counterbalanced swirl). Accordingly, the mixture ejected through the chamber exhaust has low net angular momentum and tends to resist dispersion. Thus, the exhaust is more concentrated and penetrates further into the environment. Further, the injected swirl energy is not wasted in mixing with the environment after ejection.

It is desirable that the exhaust opening be near the chamber axis, preferably centered on the axis. The closer the exhaust is centered near the axis, the more fully mixed the exhaust will be. Angular momentum conservation dictates that very large swirl velocity will occur in unmixed material initially injected with swirl, if it is forced towards the chamber axis. Thus, the background pressure force will be unable to force material sufficiently near the chamber axis to pass through a small opening until the material's angular momentum has been reduced by mixing with the opposed swirl of other injected material. On the other hand, as materials are forced towards the axis, their associated large opposed swirls results in fluid dynamic instabilities and turbulence, which greatly accelerates the mixing process.

The structure of the present invention results in several desirable phenomena. The material swirl generally has a radial variation of angular momentum (per unit volume) such that, in some regions, the magnitude of the angular momentum decreases with increasing radius. Such a configuration is fluid dynamically unstable and vigorous growth of small scale eddies or "turbulence" occurs. This instability is known as "centrifugal" or Taylor instability. This turbulence rapidly mixes materials injected with opposed swirls due to locally large unstable gradients occurring between opposed swirls.

A second phenomenon which results from the structure of the present invention is that the reagent circulation results in a high pressure region towards the outside of the chamber. This high pressure area causes in a secondary flow (teacup effect) of that reagent within the chamber that has less swirl, that is angular momentum, and therefore less centrifugal acceleration. Accordingly, that portion of the reagent within the chamber which has low angular momentum and associated centrifugal acceleration is forced towards the center of the chamber. Thus, there is selective movement of the well-mixed portions of the reagents towards the center of the chamber.

The structure of applicant's swirl mixing device substantially reduces or eliminates the centrifugal tendency of the reagents which are mixed and ejected from the chamber. Accordingly, the ejected reagent has relatively low dispersion characteristics and has a full-cone exhaust pattern. "Full cone" exhaust means that the radial profile of the ejected mixture's axial velocity component has relatively high values near the center, as opposed to the low values occurring in rapidly swirling "hollow cone" exhaust patterns that occur when the angular momentum injection rates are not counterbalanced.

In the preferred embodiment of the swirl mixing device, the intersection of the swirling flow of a first reagent with the opposed swirling flow of a second reagent results in exceedingly turbulent mixing at the interface. Additional reactants may be introduced with a swirl direction which is opposed to the net swirl of the preceeding combination.

Accordingly, and in view of the above it is an object of the present invention to provide a swirl mixing device which thoroughly mixes a plurality of reagents. Another object of the present invention is to provide a swirl mixing device which eliminates the deficiencies of the prior art and enables central mixing of the reagents thereby eliminating the interactions with the chamber wall. Another object of the present invention is to provide a swirl mixing device which provides an exhaust output having reduced dispersion and a full cone pattern. Another object of the present invention is to use the injected swirl energy in mixing the injected reagents.

BRIEF DESCRIPTION OF THE ACCOMPANYING DRAWINGS

The following is a brief description of the accompanying drawings.

DESCRIPTION OF THE PREFERRED EMBODIMENT

Figure 1:
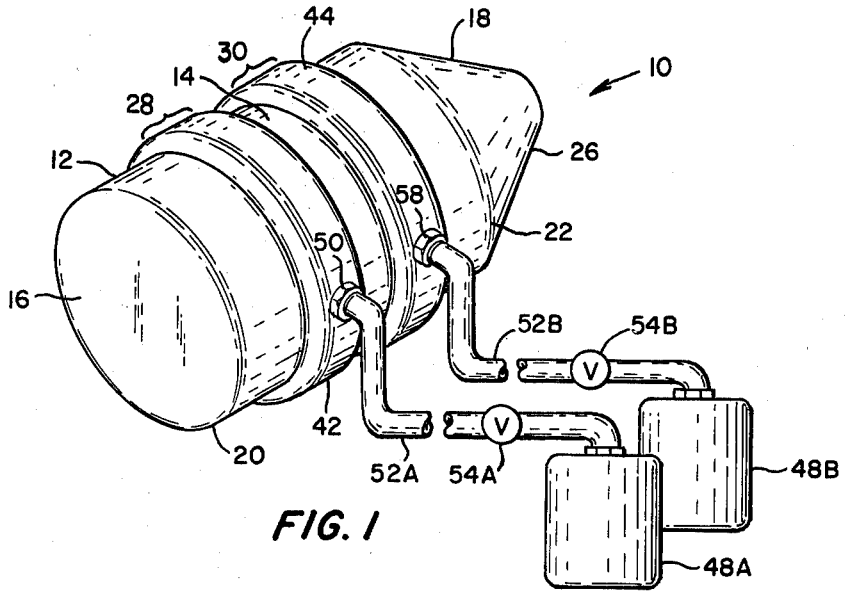
FIG. 1 is a perspective view of an improved swirl mixing device in accordance with the present invention.

Referring to FIG. 1, there is shown the swirl mixing device 10 of the present invention, composed generally of a cylindrically shaped container 12 having a cylindrical wall 14, a closed bottom 16 and an open upper exhaust 18. In the preferred embodiment, the cylindrical wall 14 is straight and intersects the bottom 16 with a smooth arched lower radius 20, and similarly intersects the exhaust 18 with a smooth arched upper radius 22.

The exhaust 18 is generally conically shaped, having a circular opening 24 (see FIG. 3) at the extreme forward end and with a generally straight side wall 26 which expands outwardly to the arched upper radius 22 intersection with the cylindrical wall 14.

A first swirl injection level 28 and a second injection level 30 are provided at predetermined locations along the length of the container 12. The first swirl injection level 28 is located nearest the bottom 16 with the second swirl injection level 30 spaced forward towards the exhaust 18. The swirl injection levels 28 and 30 are generally indicated by the first and second feed manifolds 42 and 44, respectively.

Figure 4:
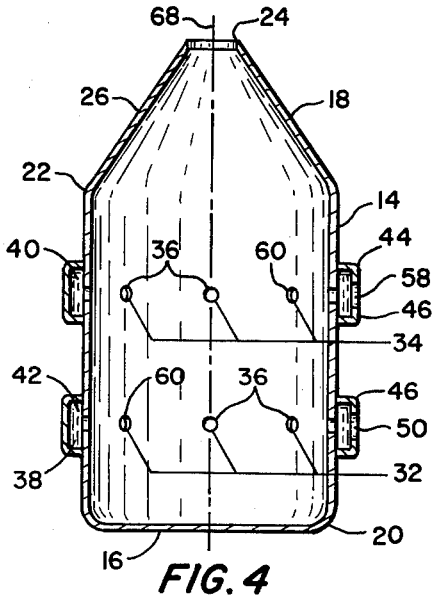
FIG. 4 is a vertical cross-sectional along lines 4—4 of FIG. 2.

As shown in FIG. 4, both swirl injection levels, 28 and 30 include, respectively, first and second injector sets, 32 and 34. Each injector set 32 and 34 contain a plurality of individual injectors 36 (see FIGS. 5 and 6). The injectors 36 of each injector set 32 and 34 communicate respectively with a first and second annular chamber 38 and 40.

By way of example, the first annual chamber 38 of the first feed manifold 42 communicates with the injectors 36 of the first injector set 32 for the first swirl injection level 28. The first feed manifold 42 is generally a "U" shaped channel 46 which circumvents the chamber 12 with the open side of the channel 46 directed inwardly. The second feed manifold 44 is structurally analagous to the first manifold 42.

Referring back to FIG. 1, a first reagent is transported to the first feed manifold 42 from first conventional storage means 48A through a connector 50 and conventional piping 52A and pressure control valve 54A. Similarly, the second reagent is transported to the second feed manifold 44 from second conventional storage means 48B through connector 58 and conventional piping 52B and pressure control valve 54B.

An alternate embodiment of the connectors 50 and 58 may include a plurality of separate connectors to each feed manifold. This alternate configuration would promote more uniform pressurization within the annular chamber. In a still further refined version, the connector may be mounted to the feed manifold at an acute angle to promote circulation of the reagent within the annular chamber. Numerous other alternatives to the feed manifold are also readily definable such as separate and individual connections to each of the respective injectors. All such alternatives are within the concept of this invention.

Figure 2:
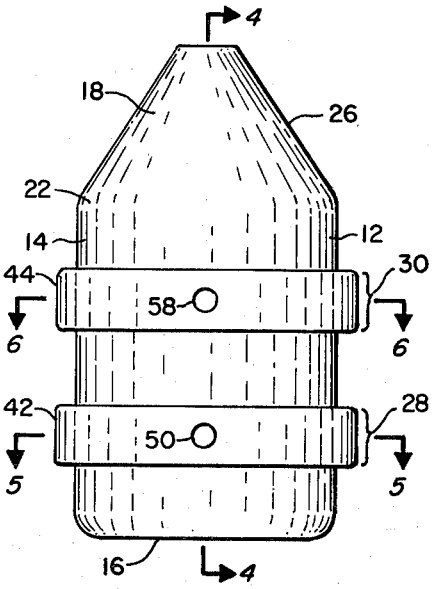
FIG. 2 is a front elevational view of the improved swirl mixing device.

Referring to FIG. 2, the swirl mixing device 10 is shown in side elevation and it may be seen that the cylindrical wall 14 of the chamber 12 is generally straight and extends from the connection with the bottom 16 at the arched lower radius 20 to the connection with the exhaust 18 at the arched upper radius 22.

The first and second feed manifolds 42 and 44, respectively, are shown evenly spaced along the length of the container 12. This spacing is predetermined and adjusted depending upon the desired mixing time of the respective reagents. If less mixing time is necessary, the second injection level 30 may be moved forward towards the exhaust 18.

Figure 3:
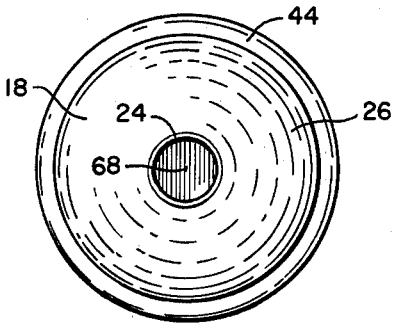
FIG. 3 is a top plan view of the improved swirl mixing device.

FIG. 3 shows the top plan view of the swirl mixing device 10. The exhaust 18 includes a circular opening 24 in the extreme forward end of the conically shaped exhaust 18. The circular opening 24 is coaxially located about and coincident with the longitudinal axis 68 (see FIG. 4) of the chamber 12 and the exhaust 18. The radius of the circular opening 24 is predetermined by adjusting the slope of the side wall 26 of the exhaust 18 and the altitude on the exhaust at which the circular opening 24 is made.

FIG. 4 shows a vertical cross-section of the swirl mixing device 10 taken generally at 4—4 of FIG. 2. The individual outputs 60 of the injectors 36 of the first and second injection levels, 28 and 30 are shown. The injectors 36 of each injector set 32 and 34 are shown in respective planes.

The U-shaped channels 46 of the first and second feed manifolds 42 and 44 are shown in cross section. The manifolds 42 and 44 may be attached to the chamber 12 in any suitable manner, such as welding. The first and second annular chambers 38 and 40 are shown in simple direct open communication with the injectors 36 of the first and second swirl injection levels, 28 and 30, respectively.

Figure 5:
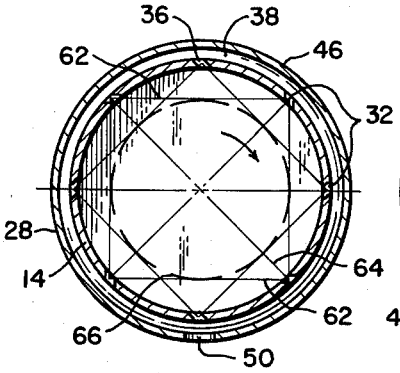
FIG. 5 is a horizontal cross-sectional along lines 5—5 of FIG. 2.
Figure 6:
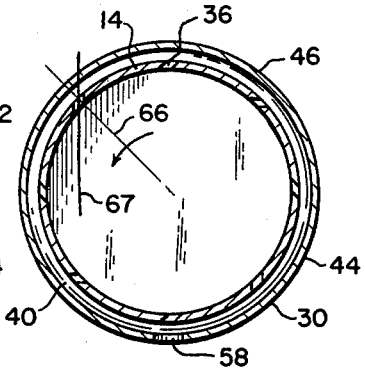
FIG. 6 is a horizontal cross-sectional along lines 6—6 of FIG. 2.

Referring to FIGS. 5 and 6, there is shown in horizontal cross-section, taken at 5—5 and 6—6 of FIG. 2, respectively, the first and second injector sets, 32 and 34 respectively. The first injector set 32 of the first swirl injection level 28, depicted in FIG. 5, shows the injectors 36 in simple communication with the first annular chamber 38. The feed manifold 42 and the cylindrical wall 14 provide the annular chamber 38 through which the reactant is distributed to all injectors 36 of the first injector set 32.

Each injector 36 has a defined injector axis 62. In the embodiment shown, each injector 36 of each injector set 32 and 34, respectively, has common axial features. Each of the injector axes 62 for each injector set 36 has substantially the same radial, azimuthal and longitudinal axial components. In the embodiment shown in FIG. 5, the longitudinal component is zero and thus the injector axis 62 lies in the same plane as the injectors 36 themselves. The injector axis 62 for each of the injectors 36 of the first injector set 32 are shown at minus 45 degrees (−45°), or 45 degrees in the counterclockwise direction from a chamber radius 64 taken through of the respective injector 36. This configuration gives each injector 36 equal radial and azimuthal components.

Because each of the eight injectors 36 in the first injector set 32 have the common axial features, they are referred to as having a given tangent circle 66, as each of the injectors axes 62 tangentially intersects a common circle, tangent circle 66, of a predetermined radius. Adjusting the radial or azimuthal components of the injector axis 62 will result in a tangent circle of a different radius.

A tangent circle is a shorthand notation for the concept of the present invention that all injectors of a given injector set have common radial, azimuthal and longitudinal components. Specifically, for the purposes of this device, the tangent circle of any injector set must have a radius less than the radius of the injector, namely, the distance from the chamber axis to the injector opening. Preferably, the tangent circle of the present invention includes a radial component which has a magnitude at least one-tenth (1/10) the magnitude of the azimuthal component. Accordingly, the tangent circle shall indicate a significant radial component.

Injection of the first reagent through the first injector set 32 results in a positive swirl or a circulation of reagent within the chamber 12 in a clockwise direction. This positive first reagent swirl produces an effective positive angular momentum of the first reagent. The positive swirling first reagent fills the chamber until it intersects the injection of the second reagent (see below).

FIG. 6 shows the second swirl injector level 30 with the second annular chamber 40 communicating with the injectors 36 of the second injector set 34. The second swirl injection level 30 has a positive angle between the chamber radius 66 and the injector axis 62 (clockwise direction) thereby injecting the second reagent into the chamber with negative swirl (counterclockwise) and negative angular momentum.

Counterbalancing the first and second reagent swirl is achieved by preselecting the injector axes, injector cross-section, number of injectors, injector pressure drop and chamber radius. Counterbalancing swirl is achieved when the mixed reagent has a small net angular momentum when compared to the angular momentum of any injected reagent. The following equation is useful as approximation for the net angular momentum injection rate, S, which is adequate for most purposes:

$$S = \sum_{i=1}^{N} M_i A_i r_i P_i \sin \phi_i$$

where:

i=the number of injection level, (it's plane assumed to be perpendicular to the container axis);

N=total number of injection levels $M_i$=number of injectors in the $i^{th}$ level (assuming all $i^{th}$ level injectors have common features);

$A_i$=cross-sectional area (normal to its axis) of an $i^{th}$ level injector (assumed identical);

$r_i$=distance of an $i^{th}$ level injector from the container axis (center line);

$\Delta P_i$=pressure drop along the $i^{th}$ level injectors; and $\phi_i$=angle between the center line of an $i^{th}$ level injector and the container radial line through the injector opening.

The characteristics of the separate injector sets can be preselected to achieve small net angular momentum injection rate by choosing them such that S is small relative to each $i^{th}$ term in the summation. The exhaust will then have small net angular momentum and a full cone pattern will result. Further, when the exhaust opening is centered near the container center line, the exhaust will be thoroughly mixed with little swirl energy remaining; thus, the injected swirl energy is not wasted in mixing with the environment outside the container and will be energetically efficient.

It is important to note that FIGS. 4 and 5 show simple open orifice injectors 36. Many variations of the structure of the injector could easily be developed within the scale of the art.

Figure 7:
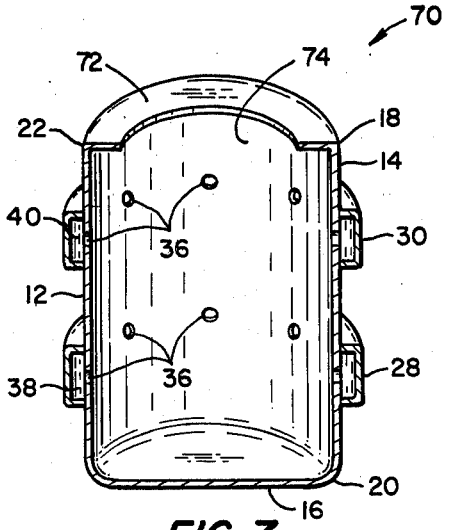
FIG. 7 is a perspective vertical sectional view of a second embodiment of an improved swirl mixing device showing a flat open exhaust.

FIG. 7 shows a vertical cross section of a second embodiment of a swirl mixing chamber having a flat open exhaust generally at 70. In this configuration, the structural features of the container 12 and the swirl injection levels 28 and 30 are analagous to the device 10 of FIG. 1. However, the exhaust 18 includes a substantially flat forward end 72. The flat forward end exhaust 72 of the second embodiment 70 intersects the cylinder wall 14 of the container 12 in a smooth arched upper radius 22.

The second embodiment 70 flat forward end 72 includes a wide circular opening 74. Comparing the opening 24 of the first embodiment shown in FIG. 3 and the wide circular opening 74 of the second embodiment shows that the relative size of the opening may vary considerably within the concept of the present invention.

It is important to note that an opening having a radius smaller than the radius of the smallest tangent circle for any of the given injector sets tends to prevent ejection of material having a residual angular momentum. In the embodiment having the wider circular opening 74, the ejected material located towards the outside of the exhaust cone will be less thoroughly mixed and will have higher angular momentum and tend to spin out and radially disperse. Material with residual angular momentum would attain large angular velocity (swirl) if it were forced toward the mixing chamber axis. This is analogous to the figure skater effect. The associated large centrifugal acceleration must be overcome by the pressure gradient force in order to drive swirling material toward the axis. Thus, material with relatively low angular momentum is selectively forced toward the mixing chamber axis.

While wide variation of exhaust port openings are within the concept of this invention, including, for example, wide circular openings, slit openings and cross openings, the preferred structure is a circular opening having a radius at least smaller than the radius of the smallest tangent circle of all injector sets.

Figure 8:
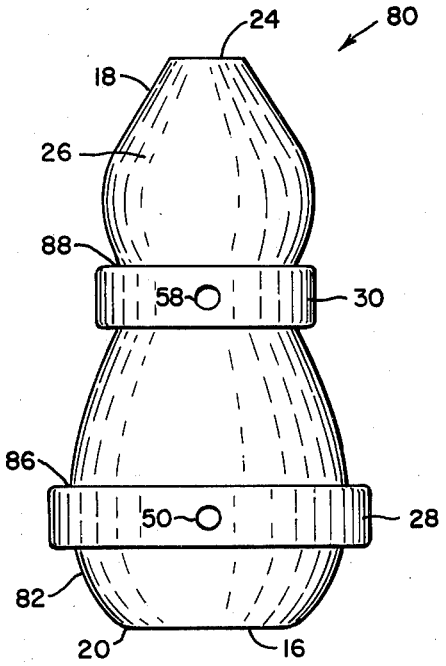
FIG. 8 is a side elevational view of a third embodiment of a swirl mixing device having a contoured mixing container.

Referring to FIG. 8, there is shown, generally at 80, a third embodiment of the swirl mixing device having a generally contoured container shape. In the contoured swirl mixing device 80, the structure of the swirl injection levels 28 and 30 and the exhaust 18 are analogous to the corresponding structures of the device 10 shown in FIG. 4.

The contoured device 80 has generally an hourglass configuration. The configuration of the chamber can be structured with a variety of contours to exploit characteristics of a swirling flow. The contoured device, 80, includes a generally rounded lower portion 82 which intersects the flat bottom 16 in a smooth arched radius 20.

The center portion of the contoured device 80 has generally a necked down portion 88 giving the cylinder its hourglass shape. This contoured device 80 has its widest point 86 coincident with the first swirl injector level 28 and has its narrowest portion 88 coincident with the second swirl injection level 30. The contour of the chamber walls are smooth and gradually arched. In the embodiment shown, the radius of the most narrow point of the contour is approximately 75% that of the radius at its widest point.

The injected first reagent in the contoured swirl mixing device 80 will pass upward through the chamber and because of the container contour, the reagent will spin up (figure skater effect) whereby the material passing the narrow point on the contour will have higher tangental velocity. At this narrow point 88, the second reagent is introduced through the second swirl injection level 30 with counterbalanced swirl.

As seen from the above, it is possible to conform the contour of the cylindrical walls and the positioning of the swirl injection levels to satisfy specific requirements and objectives of the mixing devices and the respective reagents.

Figure 9:
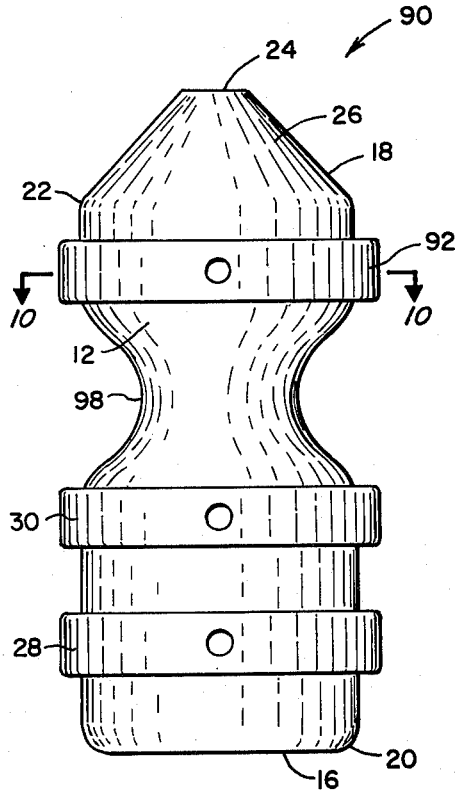
FIG. 9 is a side elevational view of a fourth embodiment of a swirl mixing device having three swirl injection levels and a contoured container.

Referring to FIG. 9, a three level swirl mixing device is shown at 90. The structural features of the three level device 90 are analagous to the structural features of the swirl mixing device 10 shown in FIG. 1.

In the three level device 90, the spacing between the swirl injection levels is adjusted to reflect the desired mixing/reaction time requirements of the respective reagents. In the embodiment shown, the spacing between the first injector level 28 and the second injector level 30 is approximately $\frac{2}{3}$ that of the spacing between the second injector level 30 and the third injector level 92. The first reactant and the second reactant have a longer mixing time than the combined first and second reactant and the third reactant. Positioning of the injector levels along the container 12 is selected to correspond to the specific requirements of the reagents.

Between the second injection level 30 and the third injection level 92, the container includes a necked-down contour having its narrowest point located at 98, approximately midway between the second and third injection levels, 30 and 92 respectively. This necked-down portion 98 promotes thorough mixing of the first and second reagents prior to introduction of the third reagent at the third injection level 92.

Figure 10:
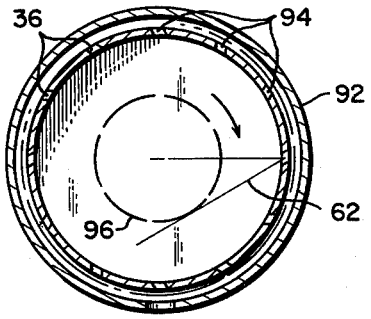
FIG. 10 is a horizontal cross-sectional view along lines 10—10 of FIG. 9.

Referring to FIG. 10, there is shown in horizontal cross section, the third injector set 94 of the third injector level 92 of the three level device 90. Each injector axis 62 has common longitudinal, azimuthal and radial features for each of the injectors 36 within the third third injection level 92. The third injector level 92 has twelve (12) injectors 36. The number of injectors 36 in an injector set can be easily varied to satisfy the specific requirements of the device.

As a general rule, the larger the number of injectors 36 around the circumference, the more consistent the pressure gradient of reageant within the chamber 12. Further, the volume efficiency of the mixing chamber is increased by increasing the number of injectors and, thereby, reducing relatively dead areas between the injectors.

As shown in FIG. 10, the tangent circle 96 of the third injector level 92 is smaller than in the first and second injector levels 28 and 30, because its radial component corresponds 30 degrees rather than 45 degrees.

In operation, the swirl mixing device is particularly well suited as a mixing chamber for fluids. Fluids such as liquids, gases or fluidized suspensions are appropriate for such a mixing device. In a small version, the mixing device can be used as a spray nozzle for a variety of applications including paint spraying devices, insecticide devices, fuel injection nozzles and the like. Such liquid atomization can be viewed as a form of fluid mixing whereby mixing between a liquid and a gas leads to small droplets. The increased surface energy per unit volume associated with small droplets must be converted from the original motion of the gas and liquid streams. The present fluid mixing device achieves this conversion efficiently as a large portion of the injected swirl energy is converted into surface energy of the many small drops. Further, the application of these devices as an atomizer produces a spray having full cone pattern and relatively uniform drop size.

In larger applications, the device can be used as a combustion chamber for example in commercial boiler whereby an oxidizing fuel is injected through the first injector level with an oxidizing agent injected through the second injector level. Combustion, burning of the mixture within the chamber is highly efficient and uniform, thereby substantially reducing noxious gases. Applications such as gas and oil burners or coal gasification plants are appropriate for such larger scale devices.

The device has applications over a wide range of sizes and applications. All such applications are within the concept of the present invention.

Variations of the structure of the swirl mixing device are within the scale of the art and such variations are considered within the concept of the present invention.

What is claimed is:

1. A mixing device comprising:

(a) a container with a bottom and an exhaust;

(b) first means formed in said container wall for symetrically injecting a first fluid reagent into said container with a given angular momentum, said first means including means for injecting such first reagent at a first predetermined tangent circle, said first tangent circle having a radius smaller than the radius of the container;

(c) second means formed in said container wall spaced from said first means, for symmetrically injecting a second reagent into said container with an angular momentum opposite that of said first reagent, said second means including means for injecting said second reagent at a second predetermined tangent circle, said second tangent circle having a radius smaller than the radius of the container and different from the radius of said first tangent circle; and (d) said first means and said second means being adapted such that the total angular momentum injection rate, summed overall injected reagents, is smaller than the angular momentum injection rate of any given injected reagent.

2. The device of claim 1 wherein said first means includes a first injector set having a plurality of symmetrically spaced individual first injectors formed in the container wall, said plurality of first injectors positioned in a first plane which is perpendicular to the container axis, and a first manifold circumventing said container forming a first annular chamber which communicates with each of said plurality of first injectors and first plumbing means for connecting a first reagent source to said first annular chamber of said first manifold; and wherein said second means includes a second injector set having a plurality of symmetrically spaced individual second injectors formed in the container wall, said plurality of second injectors positioned in a second plane which is perpendicular to the container axis and a second manifold means circumventing said container forming a second annular chamber which communicates with each of said plurality of second injectors and a second plumbing means for connecting a second reagent source to said second annular chamber of said second manifold.

3. The device, as recited in claim 2, wherein said container is cylindrically shaped and wherein said exhaust is formed of a conically shaped wall connecting to said cylindrically shaped container and terminating in a circular exhaust port, the radius of said exhaust port being smaller than the minimum tangent circle.

4. The device, as recited in claim 2, wherein such container is cylindrically shaped and wherein said exhaust is a flat member connecting said cylindrical walls with a smooth arched radius, said flat member having a circular exit port, the center of which is coincident with the longitudinal axis of the cylindrical container.

5. The device, as recited in claim 4, wherein the radius of said exit port is smaller than the minimum tangent circle.

6. A swirl mixing device for mixing two reagents comprising a cylindrically shaped container having a bottom and an exhaust and two swirl injection levels spaced along the container wall, each having respective sets of injectors;

one of said injector sets comprising a plurality of symmetrically spaced first injectors formed in the container wall oriented in a common plane perpendicular to the longitudinal axis of the container, each of said first injectors having respective injector axes, the injector axes of all of the first injectors having common radial, azimuthal and longitudinal components;

the other one of said injector sets comprising a plurality of symmetrically spaced second injectors formed in the container wall and oriented in a common plane perpendicular to the longitudinal axis of the container, each of said second injectors having respective injector axes, the axes of all second injectors having common radial, azimuthal and longitudinal components, the azimuthal component of the injector axis of the second injectors being opposite in direction to that of the azimuthal component of the injector axis of the first injectors; the azimuthal and radial components of said second injectors being different from those of said first injectors so that the tangent circle radius of said second injectors is different from that of said first injectors;

the respective sets of injectors adapted such that the total angular momentum injection rate, summed over all injection reagents, is smaller than the angular momentum injection rate of any given injected reagent.

7. The swirl mixing device, as recited in claim 6, wherein said longitudinal component of both injector sets is zero.

8. The swirl mixing device, as recited in claim 7, wherein said radial component of both injector sets has a magnitude of at least 10 percent of the respective azimuthal component.

9. A swirl mixing device for mixing a plurality of reagents comprising a cylindrically shaped container having a bottom and an exhaust, and a plurality of injection levels, each injection level including an injector set having a respective plurality of symmetrically distributed injectors, each of said injection levels positioned at predetermined locations along the container, each of said injection levels having means for injecting the respective reagent into the container with respective preselected angular momentum injection rates such that the total angular momentum injection rate summed over all injected reagents is smaller than the angular momentum injection rate of any given injected reagent.

10. The swirl mixing device, as recited in claim 9, wherein there are two injection levels having counterbalanced angular momentum injection rates.

11. A mixing device comprising a container having a longitudinal axis, a bottom, an exhaust, and a first and second injection level formed in said container wall and positioned at respective predetermined locations along the axis in respective planes perpendicular to such axis, said first injection level having means for symmetrically injecting a reagent into the container at a predetermined first tangent circle such that the first reagent will enter the container with swirl having a given angular momentum; and said second injection level including means for symmetrically injecting a second reagent into the container at a predetermined second tangent circle such that the second reagent will enter the chamber with counter swirl having an angular momentum opposite that of the first reagent, said first and second symmetrically injecting means adapted such that the total angular momentum injection rate summed over all injected reagents, is smaller than the angular momentum injection rate of any given injected reagent, said second tangent circle having a radius different from said first tangent circle.

12. The mixing device, as recited in claim 11, wherein said container is cylindrically shaped and wherein said exhaust includes a circular exit port having a radius smaller than the minimum tangent circle.

13. The swirl mixing device, as recited in claim 11, further comprising at least one additional injection level formed in said container wall, positioned at a predetermined location along the container, said injection level having means for injecting the respective reagent into the container with respective preselected angular momentum injection rates such that the total angular momentum injection rate summed over all injected reagents is smaller than the angular momentum injection rate of any given injected reagent.

14. The mixing device, as recited in claim 13, wherein said cylindrically shaped container has a contoured surface.

15. The mixing device, as recited in claim 14, wherein said contoured surface has a generally hourglass shaped configuration with its narrowest point coincident with one of said swirl injection levels.

16. The mixing device, as recited in claim 14, wherein said contoured surface is a generally hourglass configuration, the narrowest point of which is between adjacent swirl injection levels.

17. The mixing device, as recited in claim 11, wherein said symmetrical injection means of said first injection level includes a plurality of symmetrically spaced first injectors having common radial, azimuthal and longitudinal components and wherein said symmetrical injection means of said second injection level includes a second plurality of symmetrically spaced second injectors having common radial, azimuthal and longitudinal components.

18. The mixing device, as recited in claim 17, wherein the radial component of both of said first and second injectors have, respectively, a magnitude at least equal to 10 percent of the magnitude of the respective azimuthal component.

19. The mixing device, as recited in claim 11 above, wherein said exhaust includes a circular exit port with a radius smaller than the radius of the minimum tangent circle.

* * * * *